US007320667B1

(12) United States Patent
Hanna

(10) Patent No.: US 7,320,667 B1
(45) Date of Patent: Jan. 22, 2008

(54) VIBRATING HEAD MASSAGER

(76) Inventor: Stella Hanna, 3740 Highland Ave., Gurnee, IL (US) 60031

( * ) Notice: Subject to any disclaimer, the term of this patent is extended or adjusted under 35 U.S.C. 154(b) by 0 days.

(21) Appl. No.: 11/599,743

(22) Filed: Nov. 15, 2006

(51) Int. Cl.
*A61H 1/00* (2006.01)

(52) U.S. Cl. ..... 601/70; 601/46; 601/84; 601/DIG. 15

(58) Field of Classification Search ..... 601/46, 601/67, 69, 70, 72, 79, 81, 84, 134, 136; 15/21.1, 27, 28, 22.1
See application file for complete search history.

(56) References Cited

U.S. PATENT DOCUMENTS

| | | | | |
|---|---|---|---|---|
| 1,832,437 | A * | 11/1931 | Wahl | 601/81 |
| 2,049,434 | A * | 8/1936 | Erickson | 601/84 |
| 4,469,092 | A * | 9/1984 | Marshall et al. | 601/70 |
| 2006/0282025 | A1 * | 12/2006 | McDonald et al. | 601/46 |

* cited by examiner

*Primary Examiner*—Quang D. Thanh

(57) ABSTRACT

A vibrating head massager which is constructed by a first support member that is rotatable, a second support member that is extendible, and a massaging head having a plurality of massaging prongs extending away from the head for engaging a user's head.

9 Claims, 3 Drawing Sheets

VIBRATING HEAD MASSAGER

FIELD OF THE INVENTION

The present invention generally relates to a massaging apparatus and more particularly, relates to a vibrating head massager that can be mounted on top of a chair.

BACKGROUND OF THE INVENTION

In modern society, the daily grind from a stressful job frequently causes a person to suffer stress related headaches and anxiety.

When such stress related headaches occurs, an effective remedy is a head massage by using a vibrating massager. However, it is difficult for a person who is suffering stress headaches to operate a head massager on his own head. Such massaging operation must be carried out by a second person by holding a head massager against the head of the person receiving the massage. It is therefore very inconvenient when a person is alone by himself and suffering a stress headache without the recourse of any remedy.

It is therefore desirable to provide a head massager that a person can operate on himself without the help of another person.

It is therefore an object of the present invention to provide a head massager that does not have the drawbacks or shortcomings of the conventional head massagers.

It is another object of the present invention to provide a head massager that a person can operate on himself without the help of another person.

It is still another object of the present invention to provide a vibrating head massager that can be readily mounted to the top of a chair.

It is a further object of the present invention to provide a vibrating head massager wherein the massaging attachment is interchangeable.

SUMMARY OF THE INVENTION

In accordance with the present invention, a vibrating head massager is provided.

In a preferred embodiment, the present invention vibrating head massager can be constructed by a first support member that has two members rotatably connected together, a first end and a second end, the first end connected to a clip and the second end pivotally connected to a second support member by a hinge; the second support member is extendable in length and supporting a massager by its free end; and a massager including a battery compartment and a plurality of massaging prongs extending away from the massager for engaging a user's head.

BRIEF DESCRIPTIONS OF THE DRAWINGS

The invention will now be described, by way of example, with reference to the accompanying drawings, in which.

DETAILED DESCRIPTION OF THE PREFERRED AND ALTERNATE EMBODIMENT

Figure 1:
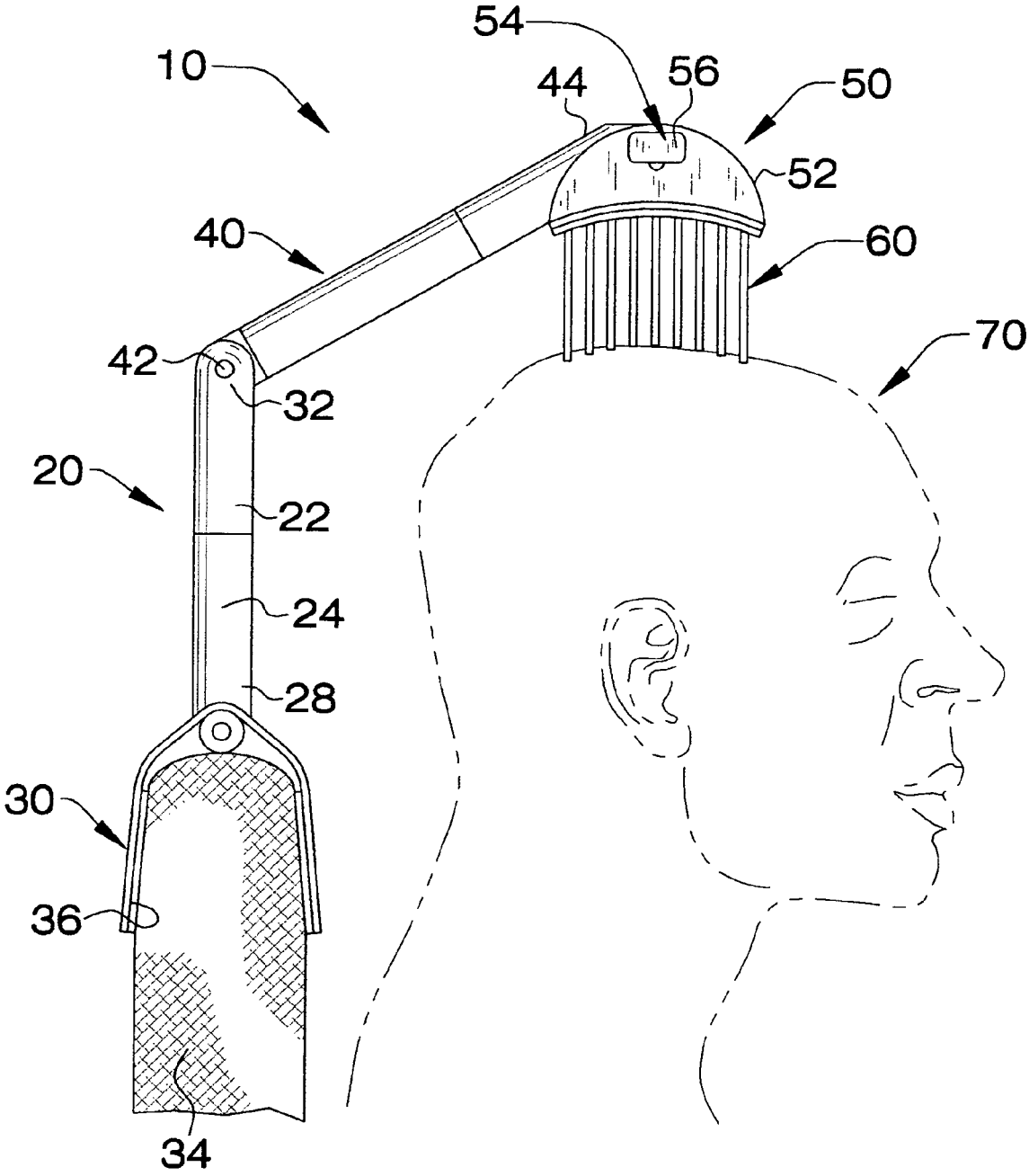
FIG. 1 is a side view of the present invention vibrating head massager in use on a person's head.

The present invention discloses a vibrating head massager that can be advantageously used by a person on himself without the help of another person.

The present invention vibrating head massager is a product that helps to alleviate the pain associated with stress headaches as well as provide relaxation. The head massager consists of a small, battery-operated appliance that can be attached to any couch or chair by using an adjustable clip. The head massager features a set of attachments. The first attachments features long, soft prongs that measures approximately 4½ to 5 inches long. The attachment itself would measure about 4 inches long and 3½ inches wide. The prongs are shorter in the center and increase in length along the periphery to accommodate the shape of the user's head. The prongs can be easily adjusted to suit any person needs and could retract into the headpiece after usage. An alternate embodiment of the present invention massaging attachment features looped prongs that can be used to massage the head and the body.

To operate the present invention vibrating head massager, a person can simply sit underneath the head massager and activate the on switch. The prongs would vibrate and move upward and downward to soothe tension and relief stress headaches.

By utilizing the present invention vibrating head massager, a person would not need to request the help of a second person to receive a head massage. The present invention head massager is therefore convenient, effective, and therapeutic. The vibrating head massager can be produced in a wide range of colors, designs, sizes, and from varying materials. As a variation, the unit can feature interchangeable attachments with prongs or looped extensions, depending on the desired massage.

The present invention vibrating head massager fulfills the need for a personal care product that can be used to relieve tension and stress headaches, as well as soothe, stimulate, and massage the head. The appealing features of the present invention vibrating head massager are its novelty, convenience, practicality, effectiveness, therapeutic qualities, eye catching design, versatility, durability, time savings, energy savings, portability, light weight, compact size, adjustable design and ease of use. The device can be easily adjusted for a wide range of massaging options. It can relieve tension, migraines and stress headaches and can allow a person to enjoy a deep massage while watching television, reading, resting in bed, ect. The present invention product offers convenience and can help to alleviate pain and discomfort from stress headaches. It can eliminate the hassle of using standard massagers, which can be difficult to apply and can restrict the user. With the present invention vibrating head massager, a person can receive a soothing and relaxing head massage without any help from another individual. The present invention vibrating head massager therefore is safe, convenient, effective, versatile, adjustable, and easy to use. In addition, its lightweight and compact design can be easily stored and transported while traveling.

Referring initially to FIG. 1, wherein a side view of the present invention vibrating head massager 10 operated on a person's head (in ghost lines) is shown. The vibrating head massager 10 is constructed by a first support member 20 formed by two members 22,24 rotatably connected together by a swivel 26 (shown in FIG. 3). The first support member 20 further having a first end 28 and a second end 32 wherein the first end 28 is connected to an adjustable clip 30 wherein an opening inside the clip 30 can be suitably adjusted to fit chair tops of different thicknesses. This is shown in FIG. 1, wherein the clip 30 is clamped onto chair top, or couch top 34. The second end 32 is pivotally connected to a second support member 40 by a pivoting hinge 42.

Figures 3, 4:
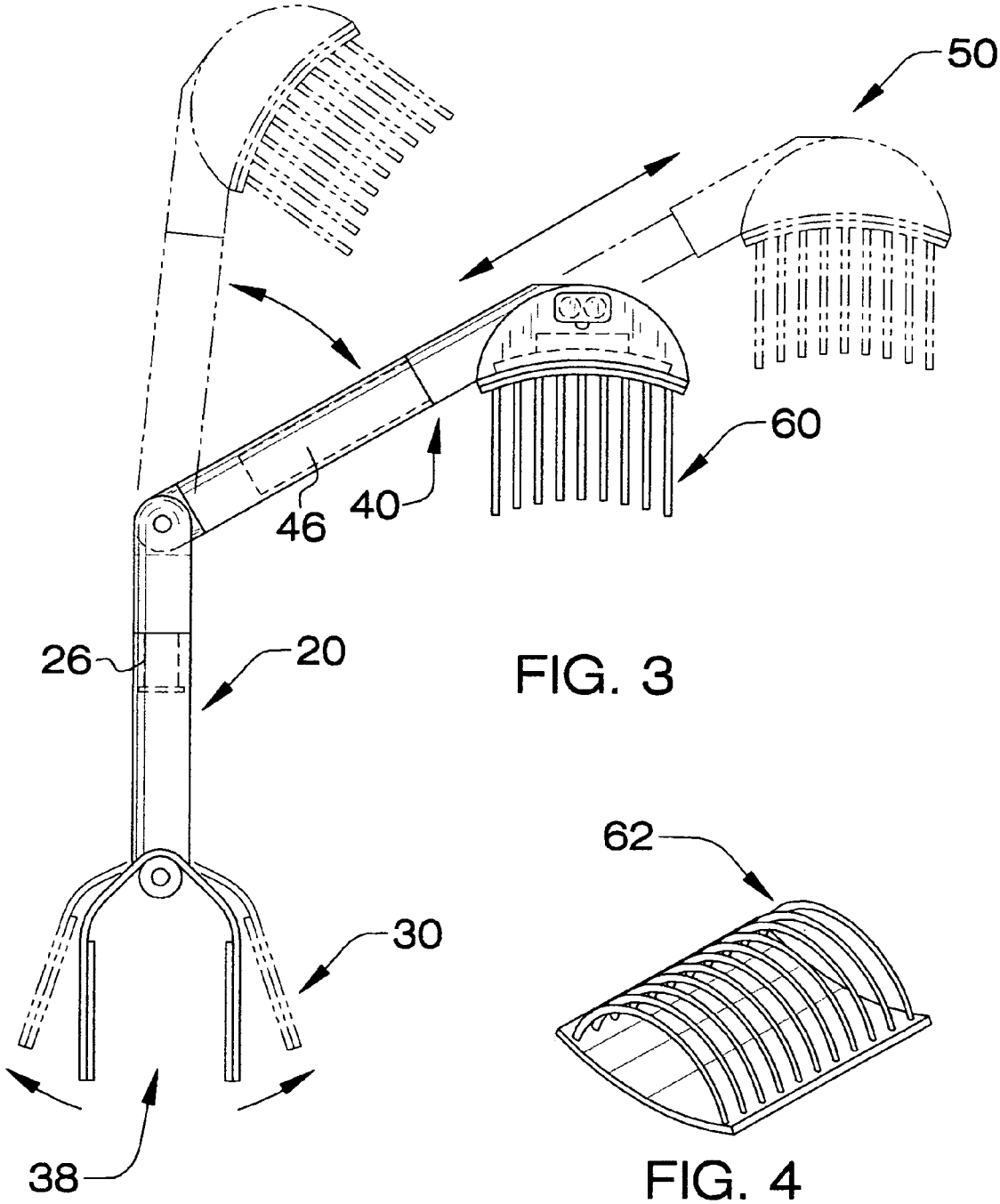
FIG. 3 is a side view of the present invention vibrating head massager illustrating the various operating positions of the massager.
FIG. 4 is a perspective view of an alternate embodiment of the massing attachment.

The second support member 40 is extendable in length, i.e. functions in a telescoping manner, as shown in FIG. 3. The second support member 40 supports a massager at its free end 44 and may be extended by a minimum of two inches.

Figure 2:
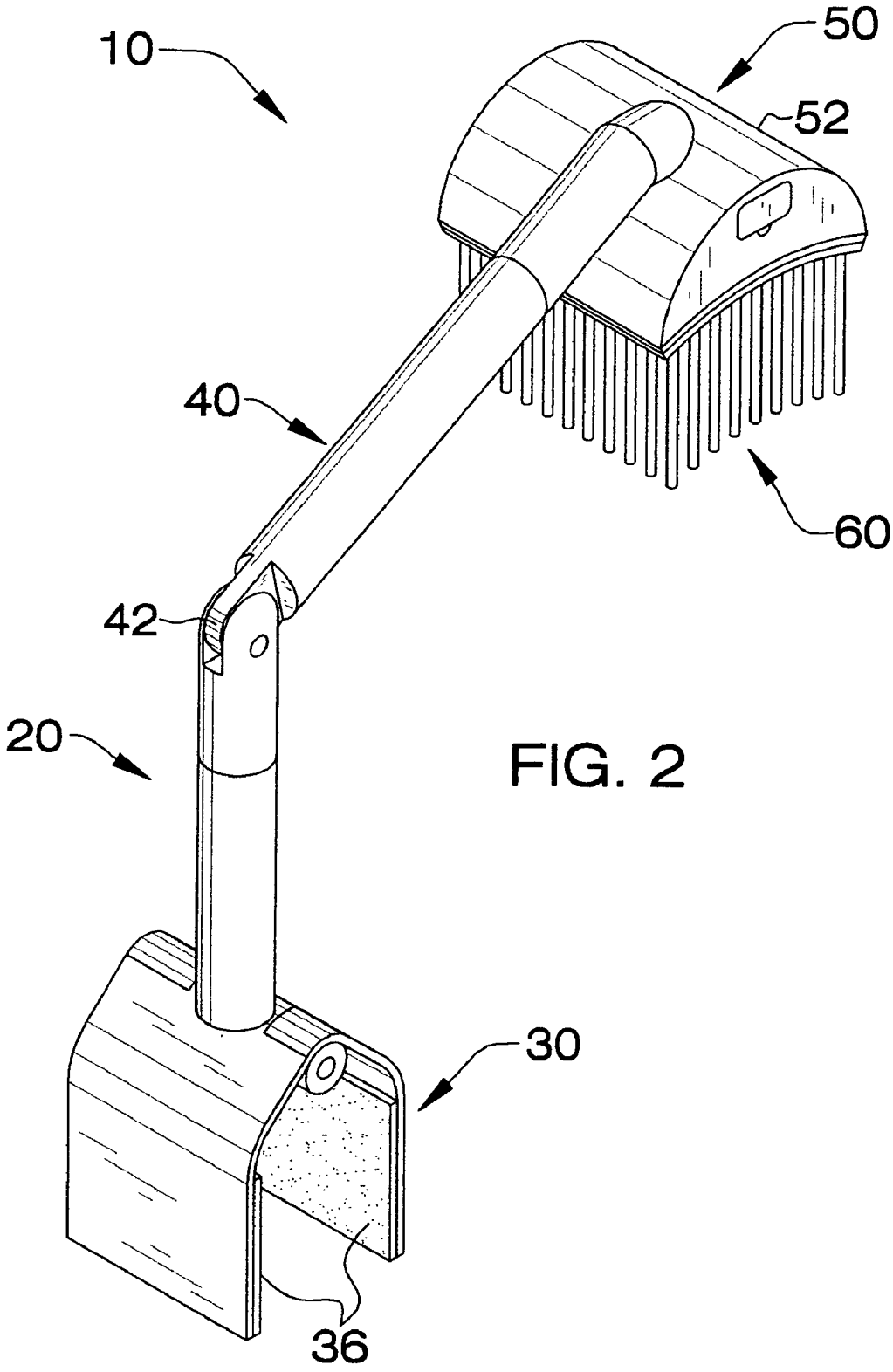
FIG. 2 is a perspective view of the present invention vibrating head massager.

The massager 50 is constructed of an outer housing 52 including a battery compartment 54 concealed by a compartment door 56. The massager may be operated by a battery or by a rechargeable battery. The massager 50 further includes a plurality of massaging prongs 60 that extends away from the massager 50 for engaging a user's head 70, a shown in FIG. 1. FIG. 2 is a perspective view of the present invention vibrating head massager 10 constructed mainly by the first support member 20, the second support member 40, and the massager 50. The outer prongs 60 of the plurality of massaging prongs having a larger length than the inner prongs in order to fit the contour of the user's head 70, as shown in FIGS. 1 and 2.

When in use, the present invention vibrating head massager 10 can first be mounted to the top of a back 34 (FIG. 1) of a chair or a couch. The mounting is made easier when the inside surface 36 of the clip 30 is covered by a layer of a protective covering which frictionally engaging the fabric of the chair or couch to achieve a sturdy mounting. As shown in FIG. 3, the opening 38 of the clip 30 can be suitably adjusted to fit chairs or couches of different sizes. After the vibrating head massager 10 is mounted on top of a chair back 34 or a couch back, the swivel 26 located inside the first support member 20 can be suitably turned to an angel such that the massager 50 is directly on top of a person head. To further improve the positioning of the massager 50 over the user's head, the length of the second support member 40 can be suitably adjusted by a telescoping mechanism 46 shown in FIG. 3. The ghost line illustrating a fully extended position of the massager 50. After the length of the second support member 40 is adjusted, the plurality of massaging prongs 60 can be positioned onto the user's head 70, as shown in FIG. 1. The massaging prongs 60 is fabricated of a suitable, pliable material such as a plastic or a rubber. The first support member 20 and the second support member 40 can be suitably made of either a metal or a plastic. The outer housing 52 of the massager 50 may also be fabricated in either plastic or metal.

FIG. 4 illustrates a perspective view of an alternate embodiment of the present invention massaging attachment in a curved prongs configuration 62. The configuration 62 can be suitably used for either head massaging or massaging of other body parts.

The present invention vibrating head massager has therefore been amply described in the above descriptions and in the appended drawings of FIGS. 1-4.

While the preferred embodiments of the invention have been described above, it will be recognized and understood that various modifications can be made in the invention and the appended claims are intended to cover all such modifications.

What is claimed is:

1. A vibrating head massager comprising;

a first support member having two members rotatably connected together, a first end and a second end, said first end connected to a clip member and said second end pivotally connected to a second support member by a hinge;

said second support member is extendable in length and supporting a massager by its free end; and a massager comprising a battery compartment and a plurality of massaging prongs extending away from said massager for engaging a user's head.

2. The vibrating head massager according to claim 1, wherein said clip member has an adjustable opening.

3. The vibrating head massager according to claim 1, wherein said first support member and said second support member are fabricated in plastic or metal.

4. The vibrating head massager according to claim 1, wherein said second support member may be extending by a minimum of two inches.

5. The vibrating head massager according to claim 1, wherein said massager is operated by a battery.

6. The vibrating head massager according to claim 1, wherein said massager is operated by a rechargeable battery.

7. The vibrating head massager according to claim 1, wherein said plurality of massaging prongs are fabricated of a pliable material for exerting a suitable pressure on a users head.

8. The vibrating head massager according to claim 1, wherein said massager is equipped with a plurality of curved prongs.

9. The vibrating head massager according to claim 1, wherein said massager is equipped with a plurality of straight prongs.

* * * * *